US005148982A

United States Patent [19]

Ekhoff

[11] Patent Number: 5,148,982

[45] Date of Patent: Sep. 22, 1992

[54] ADJUSTABLE SLIT NOZZLE

[76] Inventor: Donald L. Ekhoff, 2600 Day Rd., Gilroy, Calif. 95020

[21] Appl. No.: 698,494

[22] Filed: Apr. 26, 1991

Related U.S. Application Data

[63] Continuation-in-part of Ser. No. 648,921, Feb. 1, 1991, abandoned.

[51] Int. Cl.[5] ..... B05B 1/04; B01D 43/00

[52] U.S. Cl. ..... 239/1; 239/546; 239/568; 210/348; 210/767

[58] Field of Search ..... 239/1, 451, 455, 537, 239/546, 547, 562, 566–568, 576, 587, 588, 600, 601, DIG. 12; 210/348, 767

[56] References Cited

U.S. PATENT DOCUMENTS

| | | | |
|---|---|---|---|
| 1,159,549 | 11/1915 | Thomas | 239/546 |
| 1,289,303 | 12/1918 | Thomas | 239/546 |
| 1,795,898 | 3/1931 | Schneider | 239/546 |
| 2,161,235 | 6/1939 | Schlagintweit | 239/546 |
| 2,687,329 | 8/1954 | Hunter | 239/546 |
| 2,814,529 | 11/1957 | Arnt | 239/546 |
| 3,032,357 | 5/1962 | Shames et al. | 239/588 |
| 3,174,694 | 3/1965 | Kitabayashi | 239/601 |
| 4,245,786 | 1/1981 | Abrahamsen et al. | 239/546 |

FOREIGN PATENT DOCUMENTS

| | | | |
|---|---|---|---|
| 2013821 | 8/1979 | United Kingdom | 239/547 |

*Primary Examiner*—Andres Kashnikow
*Assistant Examiner*—Karen B. Merritt
*Attorney, Agent, or Firm*—Robert S. Smith

[57] ABSTRACT

A nozzle system for dispensing fluidic materials including powder and/or liquid including an elastic tube having at least one transverse slit. The tube can include a tube formed from a tight coil of wire or a tube formed from an elastomeric material and the slits are formed as openings between loops in the coil or cuts in the elastomeric tube. The size of the opening of the slits is determined by tension applied to the tube or by bending the tube. One means of control includes two clamp members, one on each side of the tube wherein the clamp members are hinged together. A ram between clamp members provides means for adjusting the bend in the tube in the area of the slit. The ram can be controlled by one of a number of means including pneumatic or a screw.

17 Claims, 4 Drawing Sheets

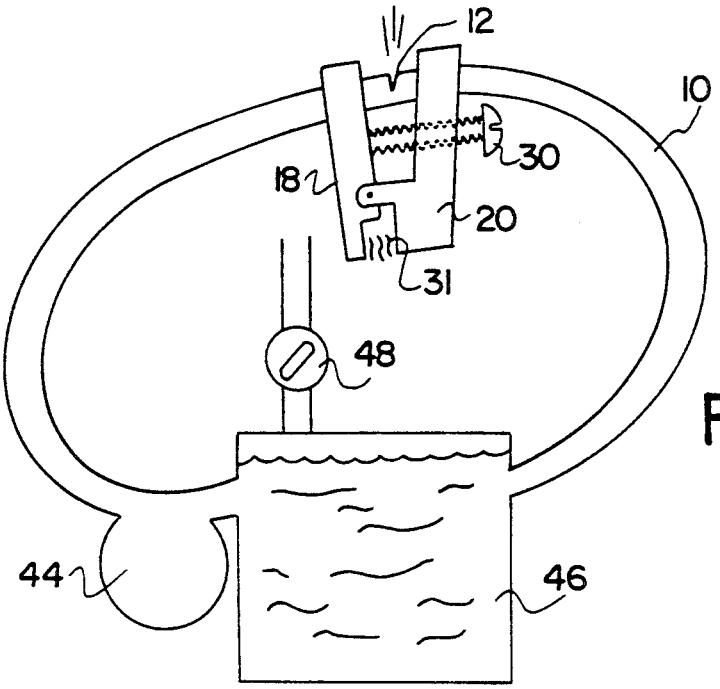
FIG. 7
FIG. 11A
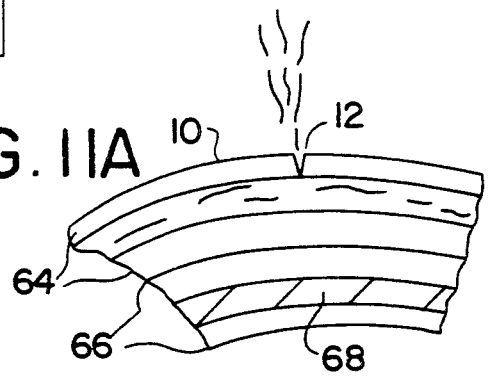
FIG. 8
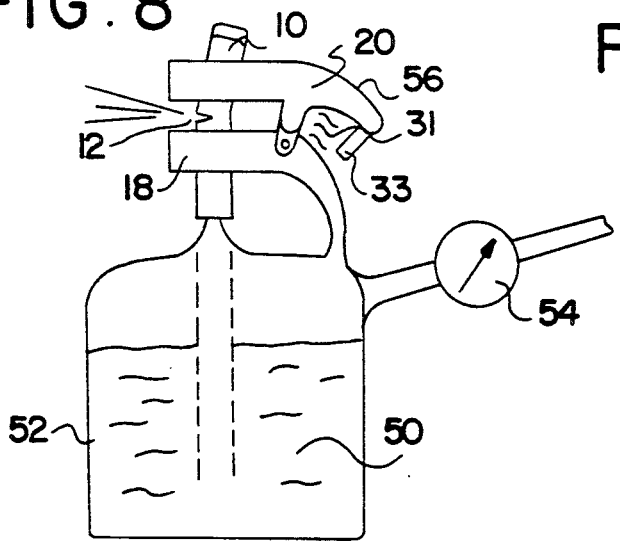
FIG. 11B
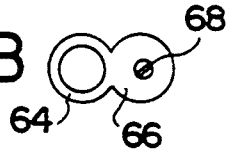
FIG. 12
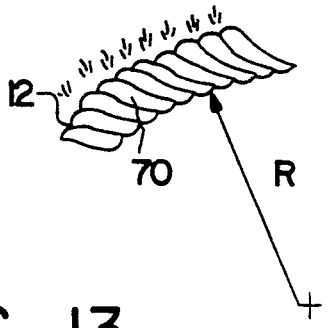
FIG. 13
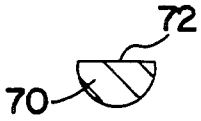

ADJUSTABLE SLIT NOZZLE

CROSS REFERENCE TO PRIOR APPLICATIONS

This application is a continuation-in-part of application Ser. No. 07/648,921 filed Feb. 1, 1991 now abandoned.

FIELD OF THE INVENTION

This invention relates to pumps and nozzles and particularly to a pumping system and nozzle that can be used to eject a fine controllable spray.

BACKGROUND AND INFORMATION DISCLOSURE STATEMENT

In the context of this specification, a nozzle is basically a device attached to a source of "fluidic" material from which the material is ejected as a stream. In the context of this specification, a fluidic material would include liquids and/or powders. Therefore, according to this definition, a nozzle is a device that dispenses paint from a sprayer, water from a garden hose, or powder from a powder coating gun. Depending on the construction of the nozzle, the stream may be ejected in different forms such as a continuous confined stream (e.g., a fire hose) or as an unconfined mist (e.g., as used for irrigation purposes in greenhouses). The nozzle provides an orifice through which the fluidic material flows from the pressurized area to the surrounding area at ambient pressure. Velocity of the flow depends on the pressure drop through the orifice divided by the resistance of the orifice to the flow of fluidic material. The shorter the orifice, (the distance between the inside and outside of the orifice) the smaller is the resistance and the greater will be the velocity of the stream issuing from the nozzle. If the cross sectional area of the nozzle is small enough and the velocity through the orifice is great enough, then the frictional force exerted on the stream by the sides of the orifice will cause the stream to disperse to a spray or even a mist.

Nozzle technology is generally concerned with—shaping the orifice and controlling the dimensions of the orifice in order to produce a desired pattern and continuity of the stream;

supporting a number of nozzles and/or moving a single nozzle in order to obtain a desired distribution of the stream.

taking precautions to prevent the collection of residues in the orifices which would otherwise cause malfunction of the nozzle.

Various constructions of nozzles have been disclosed for controllably modifying the streams issuing from nozzles. For example, the well known nozzle for a garden hose simply comprises a plug on a stem positioned adjacent to the opening to a channel leading from pressurized water to the ambient region. The position of the plug relative to the opening may be adjusted by turning a screw to which the plug is attached. When the plug is close to the opening, the resultant orifice is very small and the stream of water issues forth as a spray which fans out over a wide area from the nozzle. When the plug is spaced at a distance from the opening, the water issues as a continuous confined stream.

An example of nozzles arranged in series is in drip irrigation where a plurality of nozzles are attached to a single pipeline. In irrigating large areas such as athletic fields, the nozzle assembly is constructed to periodically vary the direction of the stream in order that a few number of nozzles can irrigate a large area.

A nozzle is inherently prone to clogging problems since the orifice is a natural collection point for particulates that ultimately impede the flow of the stream.

The problem is particularly acute in polishing operations where a slurry of liquid lubricant containing a polishing abrasive is sprayed onto a surface as the surface is subject to being polished. If the abrasive includes relatively large particles that jam into the orifice, the orifice eventually becomes clogged to the point where flow is substantially impeded.

A problem that is often encountered in these polishing operations is that the abrasive particles coagulate in quiescent regions of the slurry stream, e.g., in the bottom of a slurry container when the operation is shut down, and these coagulated particles either clog the orifice or, if they escape through the orifice, they scratch the surface being polished. One attempted solution is to continuously circulate the slurry even when the operation is not in use.

In applications where separation of a fluidic material such as a powder into one component containing particles greater than a critical size from particles smaller than the critical size, a preparatory step such as filtering through a sieve may be resorted to before sending the fluidic material through the nozzle. Of course, the problem with sieving and filtering operations is that the openings in the sieve or filter become clogged so that the filtering characteristics of the sieve or filter change with time and periodic backflushing in order to clear the clogged holes is required.

Sprays are also used extensively in rinsing operations. A frequent requirement in these applications is that the spray be applied in a fan shaped pattern. This shape of pattern requires emmision through a slot wherein the dimensions of the slot control the overall shape of the spray pattern. An array of more than one nozzle is also used to obtain a desired shape of spray pattern.

An example of a disclosure to control a spray pattern is U.S. Pat. No. 4,905,906 which discloses a spring loaded piston operating against a trigger to position a rod in relation to the opening in a nozzle.

U.S. Pat. No. 4,904,505 discloses a header assembly of nozzles, "sized to produce a mist" in order to apply a lubricant to the surface of a roll of sheet metal.

U.S. Pat. No. 4,895,413 discloses a nozzle holder that is constructed to control flow of liquid TO THE NOZZLE in a cutter roller operation.

A system of watering lawns is well known wherein the hose has a line of small holes in the holes. The size of the holes is fixed so that the size of the spray depends on the pressure of water in the hose. With this system, the rate of flow through each orifice is less than from its neighboring orifice closer to the source.

THE INVENTION

Objects

It is an object of this invention to provide a nozzle system for dispensing fluidic material as a stream wherein the fluidic material includes liquids and/or powders.

It is another object that, in one embodiment, the nozzle system incorporate a nozzle in which the orifice is a slit thereby providing a desired shape to the spray pattern issuing from the nozzle.

It is another object that the width of the opening of slit orifice be variable so that the flow of fluidized material from the nozzle can be controlled, and, in the case of spraying powders, that the slitted nozzle will permit particles of powder smaller than a desired size to pass through the slit and prevent particles larger than the critical size from passing through the slit.

It is another object to configure the slit nozzle such that, when spraying powders, clogging is minimized and when it does occur, the clogging particles may be conveniently removed.

It is another object that the slit orifice can be completely closed so that the nozzle can also be used as a shutoff valve.

It is another object that the slit nozzle and means for controlling the width of the slit may be easily installed at a desired location along a tube with a plurality of slit orifices spaced along the same tube and that the slit orifices be controllable either independent of one another or altogether.

It is another object that the row of at least one slit orifices on a tube present no obstruction to continuous flow in the tube that would act as locations where particulate matter in the stream would accumulate.

It is another object that the velocity of the spray issuing from the slit orifice be independent of the flow rate of the spray from the nozzle.

SUMMARY

This invention is directed toward a nozzle and pump system wherein the nozzle is one or more slit orifices formed in a tube and a method of varying the width of the one or more slits. The tube is formed from an elastic medium which, in the context of this specification, includes a tube comprising a tight coil of wire in which the slits are openings between neighboring loops of the coil or a tube of elastomeric material such as a flexible thermoplastic or rubber in which slits are formed by cutting a slit in the tube where the direction of the slit is transverse to the centerline of the tube. One method of controllably varying the width of the slit is to bend the tube to a controlled curvature and another method is to apply tension (stretch) the tube.

In one embodiment, the means for bending the tube are two clamps, one clamp attached to the tube on one side of the slit opposite the other clamp on the other side which preferably slides on the tube. The clamps are hingably joined to one another. A small air actuated piston between the clamps turns the hinged joint between clamps and thereby bends the tube causing the slit to open. The piston operates against a spring bias so that the size of the opening can be controlled by pressure in the piston.

In another embodiment, a plurality of slits are spaced apart from one another along a semirigid pipe. One end of the pipe is fixed and the other end has means attached to exert a bending moment on the pipe. When a bending moment is exerted on the pipe, all of the slits open simultaneously and uniformly.

The method of stretching the tube in order to form slitted openings having a uniform size is particularly applicable to the case where the tube is a tight coil of wire.

By controlling the pressure of the fluidic material in the tube and independently controlling the opening width of the slit, the velocity of the stream can be controlled independent of the rate of flow from the slit.

The crux of this invention is a nozzle means comprising one or more slitted orifices in a tube and means to controllably varying the width of the slit. Two general methods and means for opening the slit include bending the tube and stretching the tube. A number of applications and/or variations of the principles of the invention are being presented herewith. Other versions may occur to one having ordinary skill in the art after reading the specification and studying the drawings that fall within the scope of the invention.

DRAWINGS

FIG. 7 shows the tube with open slit and continuous flow of fluid through the tube and wherein the fluid is also subjected to a constant pressure to control velocity of the spray.

FIG. 8 shows an embodiment where flow is not continuous as would be useful in some applications.

FIGS. 11A and B show a double barreled tube in which one barrel contains a mallable wire and the other barrel contains the fluid to be sprayed.

FIG. 12 shows the adjustable multi slit nozzle formed from a wire coil.

FIG. 13 shows the cross section of the wire with a flattened inside to prevent entrapment of particles.

Figure 14:
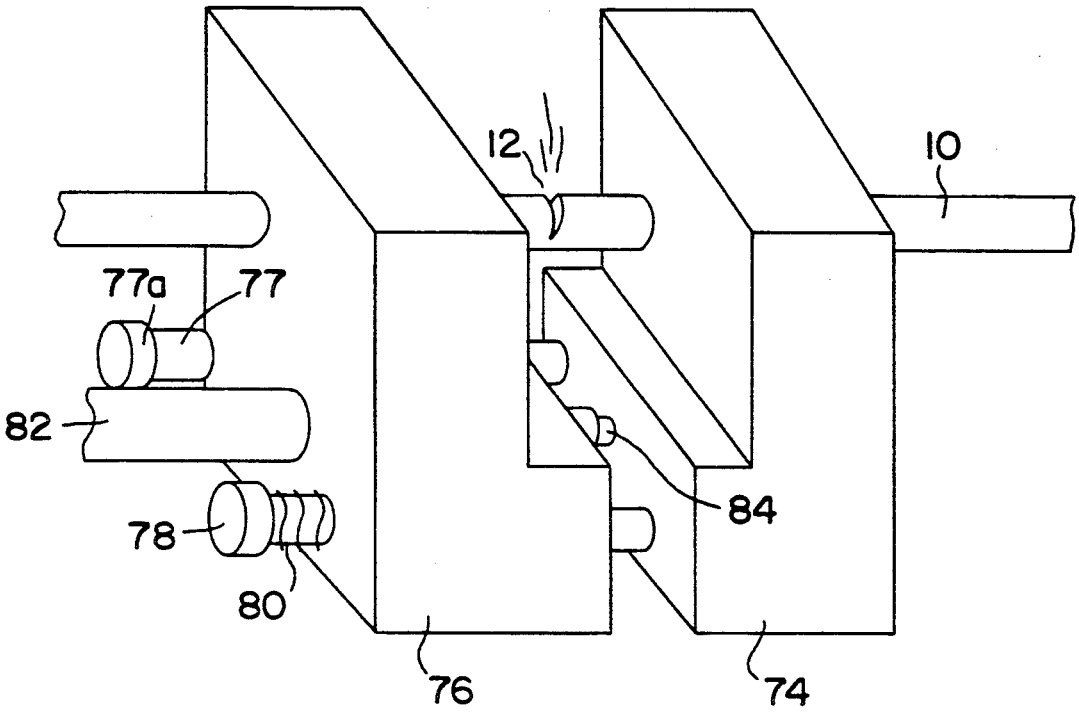

FIG. 14 shows a means of controllably opening the slitted nozzles by stretching the tube.

DETAILED DESCRIPTION OF THE BEST MODE

The following detailed description illustrates the invention by way of example and not by way of limitation of the principles of the invention. This description will clearly enable one skilled in the art to make and use the invention and describes several embodiments, adaptations, variations, alternatives and uses of the invention including what I presently believe to be the best mode for carrying out the invention.

Figure 1A:
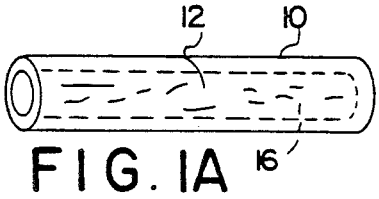
FIG. 1A shows a tube with a transverse slit.
Figure 1B:
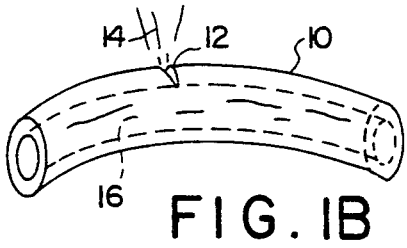
FIG. 1B shows that the slit opens when the tube is bent.

Turning now to a discussion of the drawings, there is shown in FIG. 1A and in FIG. 1B a tube 10 with a slit 12 in its side perpendicular to the central axis of the tube. In FIG. 1A the tube 10 is straight so that the slit 12 is closed. In FIG. 1B the tube 10 is bent so that the slit 12 has opened permitting spray 14 to issue forth from the pressurized fluid in the tube.

Figure 2:
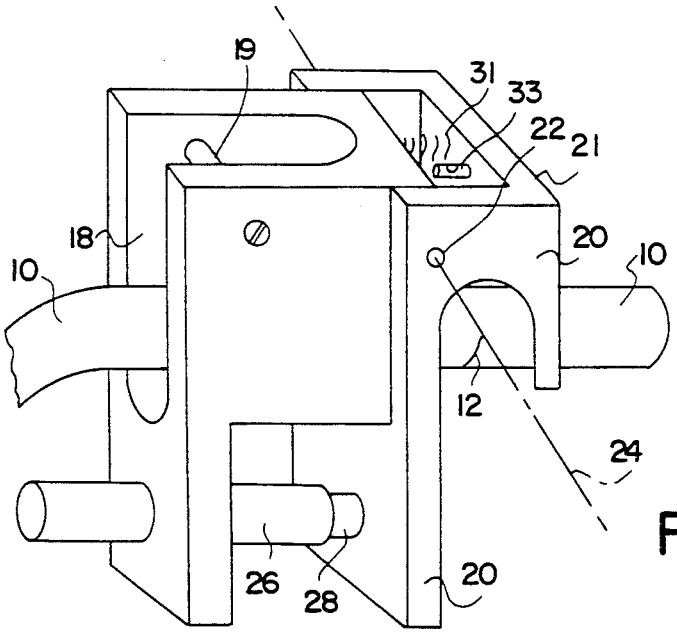
FIG. 2 shows a two part clamp that controls the size of the opening of the slit.
Figure 3:
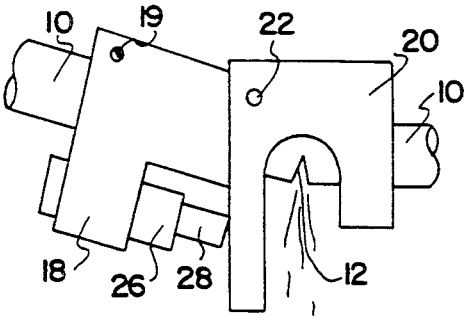
FIG. 3 shows how the clamp of FIG. 2 is activated by a pneumatic ram to open the slit to a controllable width.

FIG. 2 shows a hinged yoke that applies tension by controllably bending the tube 10 to open the slit 12. The yoke has clamp section 18 that clamps onto the tube 10 on one side of the slit 12 and clamp section 20 which is slidably attached to the tube 10 on the other side of the slit 12. The clamps are joined by hinging pin 22 so that the two clamp sections may be oriented about center line 24. Clamp 18 may be tightened onto the tube by tightening screw 26. A pneumatically operated piston 26 is fixed in clamp member 18 which forces ram 28 against clamp member 20 and thereby spreads open the slit 12 as shown in FIG. 3. The piston 26 is biased by spring 31. Positioning screw 33 in wall 21 of clamp 21 limits opening of slit 12.

Figure 4:
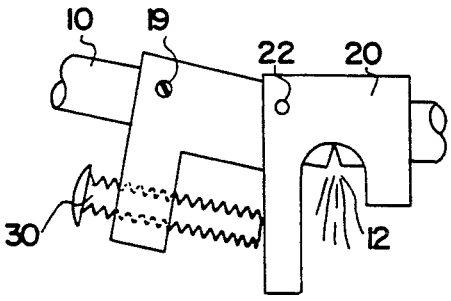
FIG. 4 shows how the clamp of FIG. 2 is activated by a screw to open the slit to a controllable width.

FIG. 4 shows a screw 30 used in place of the piston 26 shown in FIG. 3. A solenoid actuated ram (not shown) may also be used in place of the piston or screw.

Another construction that maintains an adjustable bend in the tube is shown in FIG. 11A whose cross section is shown in FIG. 11B to be double barreled, 64 and 66. One barrel 66 of the tube contains a mallable (bendable) wire 68. Iron wire is preferred in this construction. The other barrel 64 carries the fluid and contains the slit, 12. The wire may be readily bent so that the slit 12 adjacent to the bend readily opens to emit a spray of desired strength.

An advantage of the construction in FIG. 11 A and B is that the slit or slits may be located at any desired position or positions along the length of tube section 64.

Instead of the double barreled construction shown in FIG. 11 discrete straps may be located along the tube to secure the tube to the wire.

Figure 5A:
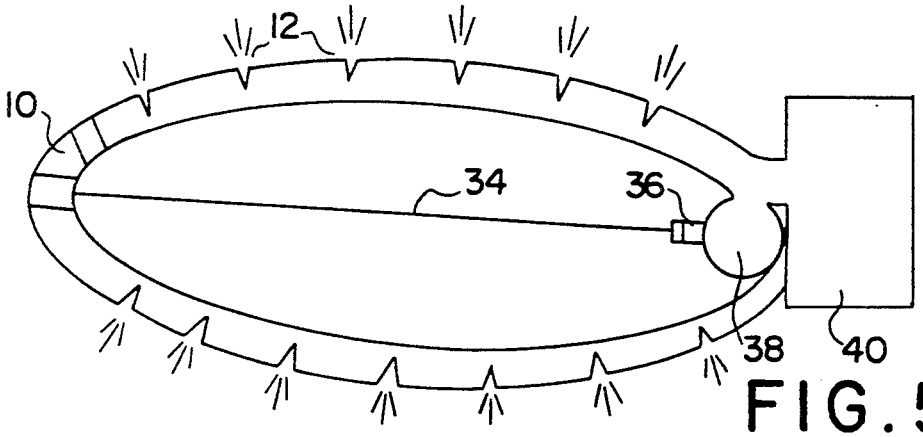
FIG. 5A shows a tube with a plurality of slits with opening widths controlled with a cable.
Figure 5B:
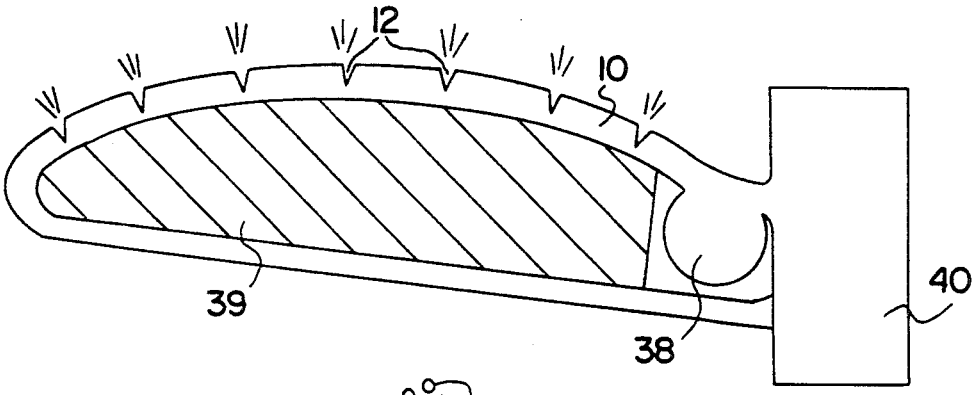
FIG. 5B shows a tube with a plurality of slits with opening width controlled by attaching the tube to a substrate having a curvature.

FIG. 5A and 5B, show embodiments of the invention wherein there may be a plurality of slit orifices 12 all controlled by one bending mechanism.

There is shown a semirigid tube 10 (or pipe) with a number of slits 12 spaced along the length of the tube 10.

One method of bending the tube is shown in FIG. 5A A cable 34 is connected between the ends of the tube. A means 36 is provided for applying tension to the cable which causes the tube to bend thereby opening the slits. In the embodiment shown in FIG. 5A, the tensioning means 36 is a ram.

As shown in 5B, another method of bending the tube is simply to attach the tube to a substrate 39 having a curved surface.

In the foregoing paragraphs there has been described an embodiment of this invention wherein the controlled opening of slitted nozzles in the tube is accomplished by constructions that controllably bend the tube. A second embodiment for controllably opening the slitted nozzles is to stretch the tube as shown in FIG. 14. There is shown a tube 10 with slits 12. The tube 10 is clamped by clamp members, 74 and 76. Clamp member 76 is slidably retained on slide rods, 77 and 78. Clamp member 74 is slidably retained on slide rod 77 and is screwed into slide rod 78. Spring 80 on slide rod 78 biases clamp members 74 and 76 toward each other so that the slitted nozzles 12 are normally closed. A pneumatic cylinder 82 is secured to clamp member 76 and whose ram 84 rests against clamp member 74. When the cylinder 82 is pressurized, the slitted nozzles 12 open up to a distance determined by setting of the threaded portion of rod 78 screwed into clamp member 74. The rod 77 with enlarged end 77A thereby acts as a stop to prevent the slits from opening up to greater than the predetermined distance.

In both 5A and 5B a pump 38 circulates fluid 40 continuously through the pipe thereby preventing accumulation of any particulate matter that would interfere with flow through the tube.

It may be noted in the foregoing descriptions that there is no interruption to continuous flow through the tube regardless as to whether the slitted nozzles are open or closed nor are there any obstructions in the tube where particulate matter may accumulate.

Figure 6:
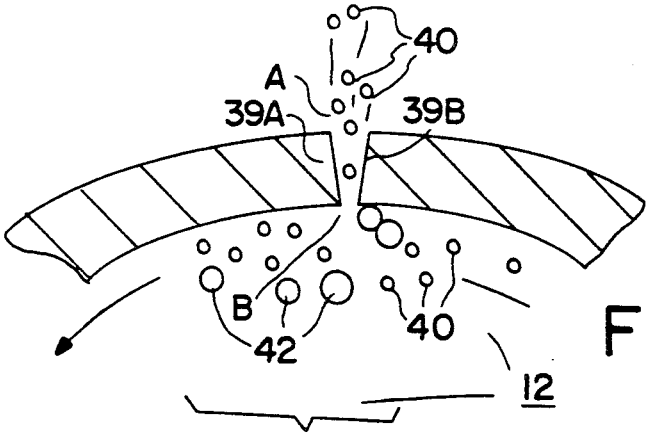
FIG. 6 shows the cross sectional shape of the slit when the tube is bent.

The particular advantage of the slitted orifice in dispersing fluids carrying particulate matter is illustrated in FIG. 6, which shows an enlarged cross sectional view of tube 10 with an expanded slit 12. FIG. 6 shows that the sides 39A and 39B of the slit 12 are not parallel and that the entrance B is narrower than the exit A. The result of this shape is that particles 40 having a size smaller than the entrance B can pass through the slit without becoming jammed in the slit whereas particles 42 larger than the entrance B may momentarily rest on the lip of the slot at B then be carried with the flow of the stream recirculating in the tube. This characteristic has a number of very useful applications as discussed in the following paragraphs.

One application is to spray a polishing slurry over a surface such as a memory disk substrate. By controlling the size of the entrance B, abrasive particles in the slurry greater than a critical size can be prevented from becoming a part of the polishing medium incident on the substrate surface. Scratching the surface being polished is thereby avoided by removing these large abrasive particles.

A second application is as a particle classifier. The major problem with sieves and filters is that they become clogged so that the throughput and filtering characteristics change with time. The anticlogging characteristics of the slit orifice of the present invention overcomes these disadvantages. By successively adjusting the size of the slit, a particle classifier is provided that can be used to separate particles according to size.

A third application is in the removal of gel particles from special coatings. The coatings used as magnetic media in the recording industry comprise a mixture of solvents, resins and catalyzing agents whose degree of mixing determines the quality (degree of homogeneity) of the coat. The coating mix contains gel particles which comprise small chunks of resin that are only partially dissolved. The gel particle is normally spherical because of surface tension around the surface of the gel particle. Of course, the more the coating mixture is stirred, the smaller these gel particles become but a point is reached where continued stirring is impractical because of the length of time required. It is very difficult to filter the gel particles using conventional filtering techniques because, the gels will eventually work their way through a depth filter and with a sieve type filter, a gel particle having a diameter that is larger than the hole in the filter, will change from a spherical (orange) shape to an elongated (turnip) shape under the pressure from the solution in order to pass through the filter.

The present invention resolves the problem of removing gel particles. With the continuous flow, a gel particle sitting momentarily on the inner edge of the slit will be swept along by the component of flow tangential to the inner surface of the tube before it has a chance to deform and pass through the slit.

FIG. 7 shows an embodiment wherein the advantages of the variable slit with unimpeded continuous flow in the tube can be provided with a pressure bias so that the rate of flow of the spray issuing from the slot can be adjusted independently from the velocity of the spray.

This feature is useful where it is required to send a fine spray a relatively long distance.

There is shown in FIG. 7 the tube 10 with slit 12, to which are attached clamping members 18 and 20 hinged together. Screw 30 is set against biasing spring 31 to provide a required slit size. A pump 44 continuously circulates fluid from the reservoir 46 through the tube 10. Pressurized air from a source (not shown) is applied to the reservoir 46 through a regulator 48.

The greater the applied pressure, the greater will be the velocity of the stream and the greater will be the rate of spray stream issuing from the slit.

However, the rate of flow can be reduced by reducing the size of the slit opening while the size of slit will have relatively little effect on the velocity of the spray stream. Therefore, by increasing the pressure and reducing the size of the slit, the velocity of the spray can be increased and simultaneously maintain constant flow rate of the spray stream.

The adjustable slit nozzle comprising a transverse slit in a flexible tube with means to bend the tube also has useful applications when a continuous flow through the tube is not required. This embodiment is shown in FIG. 8 where there is shown a container 50 containing fluid 52 pressurized from a source (not shown) through a regulator. The container communicates with the slitted nozzle assembly through tube 10 which extends from inside the container 52 to the clamping members 18 and 20 which are hinged together. The clamping members can be oriented about the hinging pin by manually pressing handle 56 on clamp 20 against biasing spring 31. Adjustment of screw 33 in handle 56 limits opening of slit 12.

The embodiment shown in FIG. 8 is particularly useful for spraying paints for at least two important reasons.

One reason is that a problem in any painting operation is to maintain clean nozzles. The typical nozzle used in paint operations comprises a spring bias plunger that slides in and out of an orifice. The nozzle has to be dismantled after every operation in order to rinse paint collected on the plunger, and that has collected in the orifice. Furthermore, these nozzle parts are expensive. In the embodiment shown, the inexpensive nozzle of this invention is a "throw away" and may simply be disconnected and replaced by a new clean slit nozzle.

Figure 9:
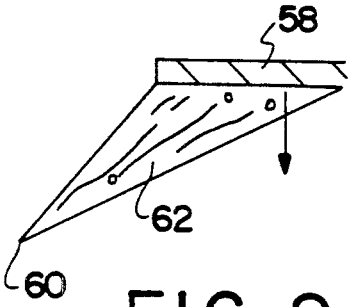
FIG. 9 shows the spray pattern from a slit.
Figure 10:
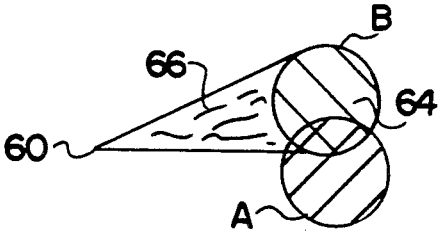
FIG. 10 (PRIOR ART)
FIG. 10 shows a spray pattern from the circular orifice of the prior art.

The second reason is that the spray pattern emitted by the nozzle is a line, as shown in FIG. 9. FIG. 9 shows the spray pattern, line 58, emitted by spray 62 from the slot nozzle at location 60. FIG. 10 shows the circular spray pattern 64 by spray 66 from the nozzle of the prior art located at position 68.

It is virtually impossible to obtain a uniform distribution with the spray pattern of FIG. 10 since the sprayed coating will always be thinnest around the edges of the surface being sprayed as the spray is moved in an attempt to provide a uniform coating. In FIG. 10, the area with the heaviest coating is cross hatched where the spray pattern has been moved from circle A to circle B.

In FIG. 9, it is seen that a uniform coating can be obtained with the line pattern simply by moving the line 58 in the direction of the arrow.

This characteristic of line distribution is extremely useful in a many operations such as the rinsing of large surfaces where the adjustable slit nozzle may be used to replace a row of nozzles of the prior art.

Another construction of the adjustable multi slit nozzle is shown in FIG. 12. There is shown a tight coil of wire 70. When the coil is straight, there is no space between the loops of the coil. However when the coil has a bend as shown in FIG. 12, slits 12 open up whose size depends on the radius, R, of curvature of the bend. The arrangements for controlling the curvature of the bent tube as discussed above (in connection with FIGS. 2–5 and 8) is obviously adaptable to a tube formed from a coiled wire.

The arrangement for opening the slitted nozzle by stretching the tube as discussed above in connection with FIG. 14 is also readily adaptable to a tube of coiled wire.

In order to prevent the collection of particles in the slit which are slightly larger than the slit opening between loops, a flat may be ground or machined on the inside of the wire as shown in FIG. 13. FIG. 13 shows a cross section of the wire forming the coil is FIG. 12, with the flat 72 formed on the inside surface of the coil.

In addition to the method of controllably opening the slit in the elastomeric tube or coil by bending. Another technique is to apply tension (or stretch) the elastomeric tube or coil as shown by the stretched elastomeric tube in FIG. 14 or coil in FIG. 12.

In the foregoing paragraphs, embodiments have been described which meet the objects of this invention. A variable nozzle has been disclosed which comprises a transverse slit in a tube wherein the size of the slit can be adjusted by applying a bending moment to the tube. The tube may be either a continuous tube in which one or more transverse slits are cut or the slits may be formed by fabricating a tight helical coil in which the slits between loops in the coil are opened to a controllable width by bending the coil.

The adjustable slit nozzle is particularly useful in applications where prevention of collection of inhomogeneities in the tube is required. This collection of inhomogeneities is prevented by continuous circulation of the fluid through the tube since the slitted tube offers no site where such inhomogeneities may accumulate. This property is operative independent of whether the inhomogeneity is a solid particle, such as the case of a polishing slurry carrying an abrasive powder or a gel particle such as would be found in a coating composition. The inherent ability to separate particles provides that the invention has an important application as a particle classifier. The combination of continuous flow, slitted adjustable nozzle and a pressure bias can be used to provide a system featuring an ability to control velocity of the spray independent of the rate of flow of the spray.

It should be understood that various modifications within the scope of this invention can be made by one having ordinary skill in the art without departing from the spirit thereof. I therefore wish my invention to be defined by the scope of the appended claims as broadly as the prior art will permit and in view of the specification if need be.

I claim:

1. An apparatus for dispensing fluidic material which comprises:

an elastic tube having a wall with at least one transverse slit;

a first clamping member attached to said tube on one side of said at least one transverse slit;

a second clamping member attached to said tube on an opposite side of said at least one transverse slit;

a joining member on which said clamping members are mounted to slide toward and away from one another;

a spring means mounted on said joining member biased to force said clamping members toward one another;

a forcing member on said first member in contact with said second member which, when activated, forces said first and second members to slide away from one another;

a limiting stop means attached to said first and second members that prevents said first and second clamping members from separating from one another more than a predetermined distance thereby providing that said at least one transverse slit will be open to a dimension.

2. An apparatus as in claim 1 wherein said tube has a first and a second end and said first end is connectable to a reservoir of said fluidic material, said apparatus comprising:

means for pumping said liquid fluidic material connected between said reservoir and said second end of said tube thereby providing that said liquid fluidic material be pumped continuously through said tube while spray is issuing from said at least one transverse slit.

3. An apparatus as in claim 1 wherein said tube comprises a tight coil of wire and said at least one transverse slit is a space between loops of said coil.

4. An apparatus as in claim 3 wherein said wire forming said coil is flat on one side and said flat side faces an inside of said coil.

5. An apparatus as in claim 1 wherein said forcing member includes a ram.

6. An apparatus as in claim 1 wherein said fluidic material is a powder comprising particles having a first size range greater than said dimension and a second size range smaller than said dimension thereby providing that when said material flows through said tube, particles having a size range greater than said dimension remain in said tube and particles having a size range smaller than said dimension issue as a spray from said at least one transverse slit.

7. An apparatus as in claim 1 wherein said fluidic material comprises a liquid containing gel particles and said apparatus includes means for pumping said liquid containing gel particles continuously through said tube at a rate that is sufficiently fast to prevent said gel particles from being squeezed through said at least one transverse slit thereby providing that said gel particles will remain within said tube and said liquid will pass through said at least one transverse slit thereby separating said liquid from said gel particles.

8. An apparatus for spraying fluid which comprises:

a tube having a wall with at least one transverse slit;

a clamping member clamped onto a first section of said tube on a first side of said at least one slit;

a sliding member slidably mounted onto a second section of said tube on a second side of said at least one slit;

a hinging means for joining said clamping member to said sliding member providing that said first section is positioned at an orientation with respect to said second section and said at least one slit is opened to a size depending on said orientation; and means for adjustably changing said orientation from one selected value to any other selected value within a range of values.

9. An apparatus as in claim 8 wherein said means for changing said orientation comprises a ram positioned between said clamping and sliding members on one side of said hinging means and a spring positioned to bias said sliding and clamping members against said ram.

10. An apparatus as in claim 9 wherein said ram is a pneumatic ram.

11. An apparatus as in claim 8 wherein said means for changing said orientation comprises:

a screw means in operable combination with said clamping and sliding members to position said clamping and sliding members in said orientation; and a spring means positioned between said sliding and clamping members such as to bias said members against said screw means.

12. An apparatus for spraying fluid which comprises:

a tube having a wall with at least one transverse slit;

a cable member having a first end attached to said tube on one side of said at least one slit and a second end;

a means for applying tension to said cable member attached to said second end and to said tube on a second side of said at least one slit thereby causing said tube to bend and said at least one slit to open.

13. An apparatus for spraying fluid which comprises:

a tube having a wall with at least one transverse slit;

a substrate having a surface with a curvature;

means to attach said tube onto said surface thereby causing said at least one slit to open to a controlled width depending on said curvature.

14. An apparatus for spraying fluid which comprises:

a tube having a wall with at least one transverse slit and having a first end and a second end;

a closed reservoir for containing said fluid connected to said first end of said tube;

means for controllably bending said tube thereby providing that when a pressurized fluid is admitted inside said tube, a portion of said fluid will pass through said at least one slit and be emitted as a spray;

means for pumping said fluid connected between said reservoir and said second end of said tube thereby providing that said fluid can be pumped continuously through said tube while spray is issuing from said at least one slit;

means for controllably pressurizing said fluid contained in said reservoir thereby providing that rate of flow of spray from said at least one slit can be controlled independently from the velocity of the spray.

15. A method for separating particles greater than a size from particles smaller than said size which includes the steps:

bending a flexible tube having at least one transverse slit in a means capable of controllably bending said tube such as to cause said at least one slit to open to a width equal to said size;

providing for said greater and smaller particles to flow continuously through said tube thereby causing a spray containing said smaller particles to issue from said slit and said larger particles to remain in said tube.

16. A method as in claim 15 wherein said greater and smaller particles are dispersed in a liquid;

17. A method as in claim 16 wherein said dispersal of particles in said liquid comprises a polishing slurry.

* * * * *